US006402983B1

(12) United States Patent
Abe et al.

(10) Patent No.: US 6,402,983 B1
(45) **Date of Patent: *Jun. 11, 2002**

(54) FLAME RETARDANT HYDRAULIC OIL CONTAINING A PARTIAL ESTER OF A POLYOL AND A MONOCARBOXYLIC ACID

(75) Inventors: Kazuaki Abe, Sodegaura; Hiromichi Seiki; Mitsuhiro Iwata, both of Ichihara, all of (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/501,152

(22) Filed: Jul. 11, 1995

Related U.S. Application Data

(63) Continuation of application No. 08/162,251, filed on Dec. 7, 1993, now abandoned.

(30) Foreign Application Priority Data

Dec. 7, 1992 (JP) ..... 4-326670

(51) Int. Cl.[7] ..... C10M 105/40

(52) U.S. Cl. ..... 252/77; 252/78.1; 252/79; 508/466; 508/469; 508/473; 508/474; 508/485; 508/486

(58) Field of Search ..... 252/56 R, 56 S, 252/79; 508/466, 469, 473, 474, 485, 486

(56) References Cited

U.S. PATENT DOCUMENTS 3,468,701 A * 9/1969 Hughes ..... 428/457
4,113,635 A * 9/1978 Sakurai et al.
4,175,045 A * 11/1979 Timony
4,302,343 A * 11/1981 Carswell et al.
4,519,932 A * 5/1985 Schnur et al.
4,645,615 A * 2/1987 Drake
5,069,806 A * 12/1991 Trivett
5,141,663 A * 8/1992 Miller ..... 252/79

FOREIGN PATENT DOCUMENTS

| | | |
|---|---|---|
| EP | 0010807 | * 10/1979 |
| EP | 0227360 | * 5/1986 |
| EP | 0286141 | * 11/1988 |
| EP | 0572273 | * 5/1993 |
| JP | 18467 | * 2/1980 |
| JP | 167907 | * 9/1984 |
| WO | 8103293 | * 11/1981 |

* cited by examiner

*Primary Examiner*—Margaret Medley
(74) *Attorney, Agent, or Firm*—Antonelli, Terry, Stout & Kraus, LLP

(57) ABSTRACT

Disclosed herein is a flame retardant hydraulic oil excellent in the flame retardancy, unaccompanied by the dangers of pinhole fire at sites of use and giving rise to no environmental contamination.

This flame retardant hydraulic oil contain a hydraulic base oil comprising as the essential component an polyol partial ester which is a product formed by reacting (A) a polyol having a total of 6 to 22 carbon atoms and a total of 3 to 6 hydroxyl groups with (B) an acyclic monocarboxylic acid having a total of 6 to 22 carbon atoms. Said polyol partial ester has a hydroxyl value of 35 mg KOH/g or more, a flash point of 290° C. or higher and an average molecular weight of 600 to 1,500.

10 Claims, No Drawings

FLAME RETARDANT HYDRAULIC OIL CONTAINING A PARTIAL ESTER OF A POLYOL AND A MONOCARBOXYLIC ACID

This application is a Continuation application of application Ser. No. 08/162,251, filed Dec. 7, 1993 now abandoned.

BACKGROUND OF THE INVENTION

1. Field of the Invention

The present invention relates to a flame retardant hydraulic oil to be used in rolling mills, die casting machines and the like in the fields of the steel making industry and the nonferrous metal industry and in hydraulic instruments and the like in the construction industry. More particularly, it relates to a flame retardant hydraulic oil excellent in the flame retardancy, unaccompanied by the dangers of pinhole fire at sites of use and giving rise to no environmental contamination.

2. Description of the Related Arts

Generally, it is essential that the flame retardant hydraulic oils have the following characteristics:

(1) they are excellent in viscosity-temperature properties to ensure the transmission of pressure and power, (2) they have appropriate viscosities to minimize the loss of pressure and power, (3) they are excellent in the heat stability, oxidative stability and lubricity to provide the longer service life, (4) they are excellent in the demulsibility to protect from the possible mixture of water, and (5) they have flash points high enough not to permit the continuous burning even if they are ignited, since it is quite likely that they are used where there are high risks of fire.

As the flame retardant hydraulic oils, there have been conventionally used those of emulsion series, those of water-glycol series, those of phosphoric acid ester series and those of fatty acid ester series However, the hydraulic oils of emulsion series and those of water-glycol series are short on the heat stability, oxidative stability and lubricity, accompanied by the difficulty to dispose of waste water containing the oils. Furthermore, the hydraulic oils of phosphoric acid ester series have the shortcomings that their viscosity-temperature properties and hydrolytic resistance are deficient; they are responsible for the deterioration of seal materials and the exfoliation of coats; and it is not easy to dispose of waste water oil by burning.

On the other hand, the hydraulic oils of fatty acid ester series are good in all of the above points and have found their application in wide segments of market. But they have the shortcomings in that they are low in the fire resistance and flame retardancy. Various studies have been conducted in an attempt to find the solution in the problems incidental to the hydraulic oils of fatty acid ester series. In fact, the technique covering the flame retardant hydraulic oils of fatty acid ester series has been disclosed, for example in Japanese Patent Applications Laid Open No. 18467/1980, No. 226096/1984, No. 125598/1988, No. 214795/1990 and No. 21697/1991.

However, all of those disclosed in said patent applications have the flame retardancy defined in terms of flash point. The most important problem of flame retardant hydraulic oils is accidents caused by pinhole fire. Specifically speaking, the flame retardant hydraulic oils should have the properties that they are hard to catch fire even if they are erupted from pinholes and, even in the case of catching fire, do not permit the oil to develop into the continuous burning if the source of fire is removed. These properties cannot be obtained merely by having high flash points alone.

The present inventors have taken note of said properties of continuous burning and conducted the studies by spraying and burning various flame retardant oils under high pressure. The studies have resulted in the finding that even the conventional flame retardant oils of fatty acid ester series do not have the fully satisfactory flame retardancy, although they are highly spoken of as flame retardant.

Thus, the present inventors have made the further intensive studies with a view to developing a flame retardant hydraulic oil of fatty acid ester series free from the properties of continuous burning. As the results, it has been found that the desired flame retardancy is provided by a specific partially esterified product having a molecular structure with hydroxyl groups. The present invention has been completed on the basis of this finding.

Among other patents, said Japanese Patent Application Laid Open No. 125598/1988 describes that an increase in the number of hydroxyl groups in the fatty acid esters is not preferable because such an increase causes their flash point to lower and that the hydroxyl value of 30 mg KOH/g or less is preferable. However, the present inventors have found from their own studies that a compound having the hydroxyl value of 35 mg KOH/g or more exhibits the good flame retardancy. The present invention has been completed on the basis of this finding.

SUMMARY OF THE INVENTION

Accordingly, an object of the present invention is to provide a flame retardant hydraulic oil containing a hydraulic base oil comprising a polyol partial ester which is a product formed by reacting (A) a polyol having a total of 3 to 12 carbon atoms and a total of 3 to 6 hydroxyl groups with (B) acyclic monocarboxylic acid having a total of 6 to 22 carbon atoms, said polyol partial ester having a hydroxyl value of 35 mg KOH/g or more, a flash point of 290° C. or higher and an average molecular weight of 600 to 1,500.

DESCRIPTION OF THE PREFERRED EMBODIMENT

The present invention will be described in greater detail below.

The flame retardant hydraulic oils of the present invention contain a hydraulic base oil comprising a fatty acid ester as the essential component. The fatty acid esters of the present invention are an polyol partial ester obtained by reacting a polyol of Component (A) with an acyclic monocarboxylic acid of Component (B).

The polyols of Component (A), which are used in the esterification to form the polyol partial esters, are polyols having a total of 3 to 12 carbon atoms and a total of 3 to 6 hydroxyl groups. Their specific examples include a trihydric alcohol such as glycerin, trimethylolethane, trimethyolpropane and trimethyolnonane; and a polyhydric alcohol such as pentaerythritol, ditrimethylolpropane, dipentaerythritol, sorbitol and mannitol. Of them, the trimethylolpropane, pentaerythritol and glycerin are preferably used. These polyols can be used singly or in their two or more mixture.

The acyclic monocarboxylic acids of Component (B), which are used in the esterification to form the polyol partial esters, are monocarboxylic acids having a total of 6 to 22 carbon atoms. Their specific examples include a straight chain saturated fatty acid such as caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachic acid and behenic acid; a straight chain unsaturated fatty acid such as undecenoic acid, oleic acid, elaidic acid, cetoleic acid, erucic acid and brassidic acid; and a branched chain saturated fatty acid such as isomyristic acid, isopalmitic acid, isostearic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid and 3,5,5-trimethylhexanoic acid. These acyclic monocarboxylic acids can be used singly or in their two or more mixture.

According to the present invention, the hydraulic base oils of flame retardant hydraulic oil comprise as the essential component the polyol partial esters formed by using the polyols of Component (A) and the acyclic monocarboxylic acids of Component (B) respectively singly or in a mixture of two compounds or more and subjecting them to the ordinary esterification.

In the processes wherein the polyols of Component (A) and the acyclic monocarboxylic acids of Component (B) are subjected to the esterification, the ratio of the charge of Component (A) to that of Component (B) can be adjusted to obtain the polyol partial esters having the hydroxyl value as desired. Furthermore, it is preferable to remove fractions of light components to perfection, to provide the flash point of 290° C. or higher.

The thus obtained esterification products can be employed either singly as they are or by mixing them to provide the viscosity as desired upon their use as the polyol partial esters in the hydraulic base oils.

According to the present invention, the esterified polyol portions to be used in the hydraulic base oil have a hydroxyl value of 35 mg KOH/g or more, preferably 50 mg KOH/g or more, more preferably 70 mg KOH/g or more. The hydroxyl value of less than 35 mg KOH/g is not preferable because it leads to an increase of completely esterified portions and the resultant hydraulic oils are undesirably as much susceptible to the continuous burning as those conventionally available. Furthermore, it is preferable that flash points be 290° C. or higher. If the flash points are lower than 290° C., the hydraulic oils are liable to catch fire.

The polyol partial esters to be used in the hydraulic base oil of the present invention have an average molecular weight (number average molecular weight) of 600 to 1,500, preferably 600 to 1000 and more preferably 650 to 950. If this molecular weight is less than 600, the hydraulic oils have the low viscosity and the low flash point and are easy to catch fire undesirably. On the other hand, if it exceeds 1,500, the hydraulic oils have the too high viscosity, undesirably susceptible to the inefficient transmission.

The kinematic viscosity is acceptable, if it is in a range good for the hydraulic oils. Ordinarily, however, it is 20 to 200 cSt, preferably 20 to 100 cSt and more preferably 40 to 80 cSt at 40° C.

As the polyol partial esters in the viscosity range as set forth above,a trimethylolpropane diester comprising a mixture of oleic acid and isostearic acid as the fatty acid is preferably used.

The flame retardant hydraulic oils of the present invention contain the hydraulic base oils comprising the thus obtained polyol partial esters as the essential component. It is preferable that said flame retardant hydraulic oils further contain high-molecular compounds having a number average molecular weight of 10,000 to 400,000. As the high-molecular compound, a polyolefin, a polyacrylate, a polymethacrylate, a polyalkylene glycol, a polyalkylene glycol alkylether, a styrene-olefin copolymer, a styrene-maleic acid ester copolymer, a polyester and the like can be mentioned. Particularly, the polymethacrylate-based polymers or the styrene-maleic acid ester copolymers are preferably used.

The base oils are made less liable to change into a mist with hydroxyl groups, and it is said high-molecular compounds which are added thereto so that mists of base oils are even harder to develop. From this point of view, their molecular weights are preferably 10,000 to 400,000 in terms of number average molecular weight. If the molecular weights are smaller than this range, said effect can hardly be obtained undesirably. If they are larger than the range, the hydraulic oils are undesirably liable to deteriorate due to shears and lose the viscosity when they are used. It is preferable that these high-molecular compounds be contained in the hydraulic oils of the present invention in a ratio of 0.01 to 2.0% by weight. If the content of high-molecular compounds is smaller than this range, the present invention is almost ineffective undesirably. If it is too much, the deterioration due to shears is more likely to develop undesirably. If necessary, the flame retardant hydraulic oils of the present invention may as well be mixed with routinely used lubricating oil additives, such as antioxidant, extreme pressure agent, rust preventives, defoaming agent, demulsifier and the like.

Examples of the antioxidant to be used herein include a phenol-based antioxidant such as 2,6-di-t-butyl-4-methylphenol, 4,4'-methylenebis(2,6-di-t-butyl-4-methylphenol; an amine-based antioxidant such as N-phenyl-α-napthylamine, N-phenyl-β-naphthylamine, phenothiazine, monooctyldiphenylamine; or a sulfur-based antioxidant such as alkyldisulfide and benzothiazole; and a zinc dialkyldithiophosphate; and the like.

Examples of the extreme pressure agent include a zinc dialkyldithiophosphate, a dialkylpolysulfide, a triarylphosphate, a trialkylphophate and the like.

Examples of the rust preventives include an alkenyl succinate, a sorbitan monooleate, a pentaerythritol monooleate, an aminephosphate and the like.

Examples of the defoaming agent include a di-methylpolysiloxane, a diethylsilicate and the like. Examples of the demulsifier include a polyoxyalkylene glycol, a polyoxyalkylene alkylether, a polyoxyakylene alkylamide, a polyoxyalkylene fatty ester and the like.

It is preferable that the flame retardant hydraulic oils as obtained by the present invention have a biodegradability of 67% or higher as the result of biodegradation tests according to the CEC method.

The thus obtained flame retardant hydraulic oils of the present invention are excellent in the flame retardancy and unaccompanied by the dangers of pinhole fire by incorporating the hydraulic base oils comprising as the essential component the polyol partial esters, which are formed by reacting the polyols of Component (A) with the acyclic monocarboxylic acids of Component (B).

Accordingly, these flame retardant hydraulic oils can find their application, for example in various hydraulic instruments, construction machines, injection machines, machine tools, hydraulically driven robots and the like. They can also be used as an engine oil, a gear oil and an industrial lubricant for other uses Moreover, they are biodegradable, capable of finding their application as a lubricating oil preferable from the viewpoint of environmental protection.

Now the present invention will be described in greater detail with reference to the examples which should not be construed as limiting the claimed scope of the present invention to their details.

EXAMPLE 1

A Dean Stark water separator equipped with a stirrer, a thermometer, an argon gas blower and a condenser was joined to a four neck flask having an internal volume of 5 liters.

Into said flask, 938 g (7 mole) of a trimethylolpropane, 2,639 g (9.36 mole) of an oleic acid and 1,343 g (4.73 mole) of a stearic acid were charged. The mixture was subjected to the esterification, heated by a mantle heater in a stream of argon.

By the time when the inside temperature was 160° C. (approximately 1 hour), water began distilling off. The temperature was raised step by step, and within approximately 3 hours thereafter 248 ml of water was collected in a trap. Thereupon, the inside temperature was 240° C. Furthermore, the temperature was raised to 260° C., and the distilland was heated with stirring for 3 hours to complete the reaction.

Thereafter, the water separator was replaced by a distillation head, and a fraction of light components was distilled off for 3 hours at 260° C. under reduced pressure (2 mmHg). Thus, 4,185 g of a fatty acid ester was obtained.

EXAMPLES 2 TO 10 AND COMPARATIVE EXAMPLES 1 TO 3

Examples 2 to 10 and Comparative Examples 1 to 3 were carried out by repeating the esterification of Example 1, except that each component was replaced by that listed in Table 1, and thus each corresponding fatty acid ester was obtained. Meanwhile, the fatty acid esters used in Comparative Example 3 were those obtained by dispensing with the processes for removing the fraction of light components.

The fatty acid esters obtained in Examples 1 to 10 and Comparative Examples 1 to 3 were respectively assessed for their quality by conducting the determination of their various properties, the high-pressure spray burning test and the biodegradation test.

The results thereof are shown in Table 1.

TABLE 1

| | Fatty acid ester (molar ratio) | | Kinematic viscosity |
|---|---|---|---|
| | Polyol | Carboxylic acid | (cSt) 40° C. |
| Example 1 | TMP (1.0) | Oleic acid (1.33)<br>Isostearic acid (0.67) | 64.58 |
| Example 2 | TMP (1.0) | Oleic acid (1.50)<br>Isostearic acid (0.50) | 60.10 |
| Example 3 | TMP (1.0) | Oleic acid (2.0) | 51.07 |
| Example 4 | TMP (1.0) | Isostearic acid (2.0) | 120.7 |
| Example 5 | glyc (1.0) | Oleic acid (1.0)<br>Isostearic acid (1.0) | 59.63 |
| Example 6 | PE (1.0) | Oleic acid (2.0) | 106.2 |
| Example 7 | PE (1.0) | Oleic acid (3.0) | 86.46 |
| Example 8 | PE (1.0) | 2ethylhexanoic acid (2.1)<br>Oleic acid (1.2) | 60.24 |
| Example 9 | DPE (1.0) | Caproic acid (4.0)<br>Oleic acid (1.0) | 71.16 |
| Example 10 | DPE (1.0) | Caproic acid (3.0)<br>Capric acid (1.0)<br>Oleic acid (1.0) | 75.26 |
| Comparative Example 1 | TMP (1.0) | Oleic acid (3.0) | 53.30 |
| Comparative Example 2 | | Quintolubric*1 | 55.30 |
| Comparative Example 3 | TEMP (1.0) | Oleic acid (2.0) | 50.87 |

| | Hydroxyl value (mgKOH/g) | Flash point (° C.) | Continuous burning time (second) |
|---|---|---|---|
| Example 1 | 70 | 308 | 1 |
| Example 2 | 69 | 310 | 3 |
| Example 3 | 72 | 300 | 15 |
| Example 4 | 75 | 296 | 1 |
| Example 5 | 80 | 294 | 6 |
| Example 6 | 145 | 295 | 1 |
| Example 7 | 52 | 302 | 1 |
| Example 8 | 52 | 306 | 3 |
| Example 9 | 55 | 320 | 1 |
| Example 10 | 48 | 310 | 1 |
| Comparative Example 1 | 10 | 308 | 30< |
| Comparative Example 2 | 14 | 294 | 30< |
| Comparative Example 3 | 71 | 262 | 30< |

*1Commercially available (produced by Quaker Chemical Corp.)

The abbreviations in the table represent:

TMP: Trimethylolpropane glyc: Glycerin

PE: Pentaerythritol

DPE: Dipentaerythritol

As shown in Table 1, those of Examples 1 to 10 were found to have a very short continuous burning time at the high-pressure spray burning test and be excellent in the flame retardancy. On the other hand, it was found that all those of Comparative Examples 1 to 3 had "the properties of continuous burning," and it was clearly established that the acceptable flame retardancy cannot be obtained by merely having high flash points alone.

Furthermore, the biodegradation tests were conducted in accordance with the CEC method, with the result that all of the fatty acid esters obtained in Examples 1 to 10 had the biodegradability of 99% or higher.

Meanwhile, the determination of various properties and the high-pressure spray burning test were carried out in the following manner:

1) Kinematic Viscosity

Determined in accordance with JIS K-2283.

2) Hydroxyl Value

Determined in accordance with JIS K-0070 by the use of the pyridine-acetyl chloride method.

3) Flash Point

Determined in accordance with JIS K-2274 by the use of Cleveland open-cup flash point test (COC).

4) High-pressure Spray Burning Test

The test sample oils were sprayed under high pressure, ignited by the burner and subjected to the preliminary burning for 10 seconds. Then, the flame of the burner was removed, and the continuous burning time thereafter was determined as the indicator of flame retardancy.

When the test sample oils were found to burn for more than 30 seconds, the tests were discontinued immediately and it was decided that the relevant test sample oils have "the properties of continuous burning".

Test conditions:

Spraying pressure: 70 kg/cm2G (applying the pressure by the use of nitrogen)

Temperature of test sample oils: 60° C.

Nozzle: Monarch 60° PL2.25 (of hollow cone type)

Distance between nozzle and burner: 10 cm

Preliminary burning time: 10 seconds

Internal volume of autoclave: 1 liter

5) Biodegradation Test

Carried out in accordance with CED-L-33-T-82 by the use of CEC method.

EXAMPLES 11 TO 19

The high molecular compounds listed in Table 2 were added to the fatty acid esters obtained in Examples 2, 3, 5 or 8, and the high pressure spray burning test by the use of each such combination was carried out by repeating the procedure of Example 1. The results thereof are shown in Table 2.

TABLE 2

| | Fatty acid ester base oil (molar ratio) | | High-molecular |
|---|---|---|---|
| | Example No. | Composition | compound |
| Example 11 | 2 | TMP (1.0)<br>Oleic acid (1.5)<br>Isostearic acid (0.5) | Polymethacrylate* |
| Example 12 | 2 | TMP (1.0)<br>Oleic acid (1.5)<br>Isostearic acid (0.5) | Styrene-maleic acid ester copolymer |
| Example 13 | 2 | TMP (1.0)<br>Oleic acid (1.5)<br>Isostearic acid (0.5) | Hydrogenated styrene-butadiene copolymer |
| Example 14 | 2 | TMP (1.0)<br>Oleic acid (1.5)<br>Isostearic acid (0.5) | Styrene-isoprene copolymer |
| Example 15 | 3 | TMP (1.0)<br>Oleic acid (2.0) | Polymethacrylate* |
| Example 16 | 5 | glyc (1.0)<br>Oleic acid (1.0)<br>Isostearic acid (1.0) | Styrene-maleic acid ester copolymer |
| Example 17 | 8 | PE (1.0)<br>2-ethylhexanoic acid (2.1)<br>Oleic acid (1.2) | Polymethacrylate* |
| Example 18 | 8 | PE (1.0)<br>2-ethylhexanoic acid (2.1)<br>Oleic acid (1.2) | Polypropylene glycol dimethylether |
| Example 19 | 8 | PE (1.0)<br>2-ethylhexanoic acid (2.1)<br>Oleic acid (1.2) | Ethylene-propylene copolymer |

| | Number average molecular weight | Amount of addition (wt. %) | Continuous burning time (second) |
|---|---|---|---|
| Example 11 | 140,000 | 1.1 | 1 |
| Example 12 | 300,000 | 0.4 | 1 |
| Example 13 | 140,000 | 0.8 | 1 |
| Example 14 | 300,000 | 0.4 | 1 |
| Example 15 | 140,000 | 2.0 | 1 |
| Example 16 | 300,000 | 0.4 | 1 |
| Example 17 | 140,000 | 1.3 | 1 |
| Example 18 | 30,000 | 0.5 | 1 |
| Example 19 | 20,000 | 0.5 | 1 |

*These polymethacrylates were a copolymer of alkyl group having 1 carbon atom and alkyl group having 12 carbon atoms.

As evident from Table 2, the continuous burning time was made shorter by far with the addition of high-molecular compounds to the fatty ester base oils.

What is claimed is:

1. A flame retardant hydraulic oil containing a hydraulic base oil comprising a polyol partial ester which is a product obtained by reacting (A) a polyol having a total of 3 to 12 carbon atoms and a total of 3 to 6 hydroxyl groups with (B) at least one acyclic monocarboxylic acid having a total of 6 to 22 carbon atoms, said polyol partial ester having a hydroxyl value of 35 mg KOH/g or more, a flash point of 290° C. or higher and a number average molecular weight of 600 to 1,500; said hydraulic oil having a flame retardancy as expressed in terms of the length of continuous burning time of not more than 30 seconds.

2. The flame retardant hydraulic oil as set forth in claim 1, further containing 0.01 to 2.0% by weight of a high-molecular compound having a number average molecular weight of 10,000 to 400,000.

3. The flame retardant hydraulic oil as set forth in claim 2, wherein said high-molecular compound is selected from the group consisting of polymethacrylate-based polymer and styrene-maleic acid ester-based copolymer.

4. The flame retardant hydraulic oil as set forth in claim 1, having a biodegradability of 67% or higher as the result of a biodegradation test on the basis of CEC method.

5. The flame retardant hydraulic oil as set forth in claim 2, having a biodegradability of 67% or higher as the result of a biodegradation test on the basis of CEC method.

6. The flame retardant hydraulic oil as set forth in claim 3, having a biodegradability of 67% or higher as the result of a biodegradation test on the basis of CEC method.

7. The flame retardant hydraulic oil as set forth in claim 1, wherein the hydraulic base oil consists essentially of the polyol partial ester.

8. A flame retardant hydraulic oil consisting essentially of a polyol partial ester as a hydraulic base oil, said polyol partial ester being a product obtained by reacting (A) a polyol having a total of 3 to 12 carbon atoms and a total of 3 to 6 hydroxyl groups with (B) at least one acyclic monocarboxylic acid having a total of 6 to 22 carbon atoms, said polyol partial ester having a hydroxyl value of 35 mg KOH/g or more, a flash point of 290° C. or higher and a number average molecular weight of 600 to 1,500, and up to 2.0% by weight of a high molecular weight compound having an average molecular weight of 10,000 to 400,000; said hydraulic oil having a flame retardancy as expressed in terms of the length of continuous burning time of not more than 30 seconds.

9. The flame retardant hydraulic oil as set forth in claim 8, wherein said polyol is selected from the group consisting of trimethylolpropane, glycerin, pentaerythritol and dipentaerythritol and said at least one monocarboxylic acid is selected from the group consisting of oleic acid, isostearic acid, 2-ethylhexanoic acid, caproic acid, and capric acid.

10. The flame retardant hydraulic oil as set forth in claim 8, wherein the high molecular compound is selected from the group consisting of polymethacrylate, styrene-maleic acid ester copolymer, hydrogenated styrene-butadiene copolymer, styrene-isoprene copolymer, polypropylene glycol dimethylether and ethylene-propylene copolymer.

* * * * *